US008246525B2

(12) United States Patent
Chen

(10) Patent No.: US 8,246,525 B2
(45) Date of Patent: Aug. 21, 2012

(54) DUMBBELL HAVING ROLLING OR SHAKING DEVICE

(76) Inventor: Paul Chen, Richmond (CA)

( * ) Notice: Subject to any disclaimer, the term of this patent is extended or adjusted under 35 U.S.C. 154(b) by 0 days.

(21) Appl. No.: 12/927,151

(22) Filed: Nov. 8, 2010

(65) Prior Publication Data

US 2012/0115690 A1 May 10, 2012

(51) Int. Cl.
*A63B 21/072* (2006.01)
*A63B 22/18* (2006.01)
*A63B 21/22* (2006.01)

(52) U.S. Cl. ..... 482/108; 482/110; 482/131

(58) Field of Classification Search ..... 482/44–46, 482/50, 81, 82, 106–110, 131, 132
See application file for complete search history.

(56) References Cited

U.S. PATENT DOCUMENTS 1,524,888 A 2/1925 Schuur
2,447,218 A 8/1948 Trzesniewski
4,632,391 A * 12/1986 Orak ..... 482/110
4,743,017 A 5/1988 Jaeger
5,518,478 A 5/1996 Liang
5,674,162 A * 10/1997 Ellingson et al. ..... 482/110
5,692,944 A * 12/1997 Pellicone ..... 446/170
6,099,444 A * 8/2000 Domenge ..... 482/110
6,514,179 B1 * 2/2003 Yu ..... 482/44
6,656,093 B2 12/2003 Chen
6,837,833 B2 * 1/2005 Elledge ..... 482/108
7,037,243 B1 * 5/2006 Clancy ..... 482/81
7,841,972 B1 * 11/2010 Huang et al. ..... 482/108
7,846,076 B2 * 12/2010 Salzwimmer et al. ..... 482/110
7,927,264 B2 * 4/2011 Verheem ..... 482/110
8,118,717 B1 * 2/2012 Lai ..... 482/108
2012/0040805 A1 * 2/2012 Chen ..... 482/110

* cited by examiner

*Primary Examiner* — Loan Thanh
*Assistant Examiner* — Victor K Hwang
(74) *Attorney, Agent, or Firm* — Charles E. Baxley

(57) ABSTRACT

A barbell or dumbbell or exercise device includes a handle having two end portions, a weight member attached to either of the end portions of the handle and having a ball guiding raceway for engaging with a rolling device which is movable along the ball guiding raceway of the weight member for generating a vibration to the weight member and the handle, the weight member includes a housing attached onto the weight member and engaged with the rolling device for retaining the rolling device in the weight member, for example, the housing includes a chamber for receiving the weight member and includes a peripheral flange extended radially and inwardly into the chamber and secured to the weight member.

7 Claims, 7 Drawing Sheets

DUMBBELL HAVING ROLLING OR SHAKING DEVICE

BACKGROUND OF THE INVENTION

1. Field of the Invention

The present invention relates to a barbell or dumbbell or exercise device, and more particularly to a barbell or dumbbell or exercise device including a swiveling or shaking or vibrating or revolving or rolling device for generating a vibration to the weight member or to the weight carrier or the handle and for vibrating the hands of the user and for exercising the upper muscle groups of the user.

2. Description of the Prior Art

Typical barbells or dumbbells comprise a handle to be grasped or held by the user, and a number of weight plates to be attached onto the ends of the handle for weight lifting or exercising purposes, or for exercising or training the upper muscle groups or the lower muscle groups of the user.

For example, U.S. Pat. No. 1,524,888 to Schuur, U.S. Pat. No. 2,447,218 to Trzesniewski, U.S. Pat. No. 4,743,017 to Jaeger, U.S. Pat. No. 5,518,478 to Liang, and U.S. Pat. No. 6,656,093 to Chen disclose several typical dumbbells each comprising two or more weight plates or weight members selectively or adjustably attaching or mounting onto the handle shaft or handle bar for being held or grasped by the users to train the upper muscle groups or the lower muscle groups of the user.

However, for all of the typical dumbbells or exercise devices, no swiveling or shaking or vibrating or revolving or rolling devices have been provided for generating a vibration to the weight carrier or handle and/or the dumbbell and/or the weight members, or for vibrating the hands of the user and for further exercising the upper muscle groups of the user.

The present invention has arisen to mitigate and/or obviate the afore-described disadvantages of the conventional barbells or dumbbells or exercise devices.

SUMMARY OF THE INVENTION

The primary objective of the present invention is to provide a barbell or dumbbell including a swiveling or shaking or vibrating or revolving or rolling device for generating a vibration to the weight member or to the weight carrier or handle and/or the dumbbell and for vibrating the hands of the user and for exercising the upper muscle groups of the user.

In accordance with one aspect of the invention, there is provided an exercise device comprising a handle including two end portions, a weight member attached to either of the end portions of the handle and including a ball guiding raceway formed therein, and a rolling device slidably received and disposed in the ball guiding raceway of the weight member and movable along the ball guiding raceway of the weight member for generating a vibration to the weight member and the handle and for exercising the upper muscle groups of the user.

The weight member includes a housing attached onto the weight member and engaged with the rolling device for stably and solidly confining and retaining the rolling device in the weight member.

The housing includes a chamber formed therein for receiving the weight member, and includes a peripheral flange extended radially and inwardly into the chamber thereof and engaged with the weight member and secured to the weight member for stably and solidly retaining the rolling device in the weight member.

The housing includes a ball guiding raceway formed therein and aligned with the ball guiding raceway of the weight member for engaging with the rolling device and for stably and solidly guiding the rolling device to move along the ball guiding raceways of the weight member and the housing and to move relative to the weight member and the housing.

The handle includes a bore formed therein and includes a pole engaged into the bore of the handle, and the pole includes two end portions extended out of the handle for supporting the weight member.

The weight member includes a carrier attached to either of the end portions of the pole, and includes a compartment formed in the weight member for receiving the end portion of the pole and the carrier.

The carrier includes a frame having a recess formed in the frame, and the weight member includes an end wall having an anchor extended therefrom and engaged with the recess of the frame of the carrier and attached to the frame of the carrier for attaching to the end portion of the pole.

A shield may further be provided and attached to the end portions of the handle and the carrier for shielding or covering the spaces between the handle and the carrier and for preventing the dust or dirt from entering into the spaces between of the handle and the carrier. The handle includes a casing formed and provided on each of the end portions of the handle, and the carrier includes a frame, the shield is attached or secured between the casing of the handle and the frame of the carrier.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
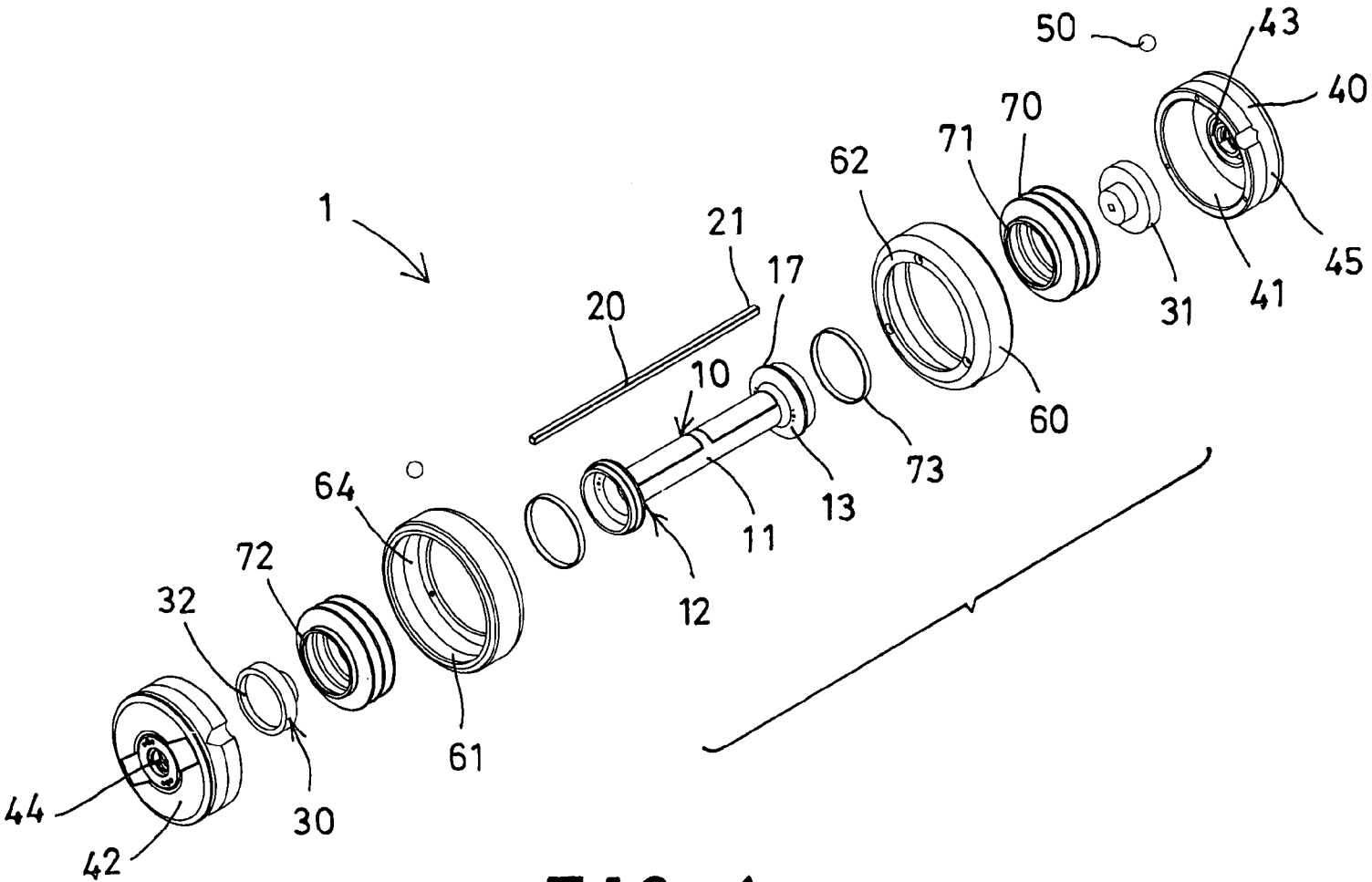
FIG. 1 is a partial exploded view of a barbell or dumbbell in accordance with the present invention.
Figure 2:
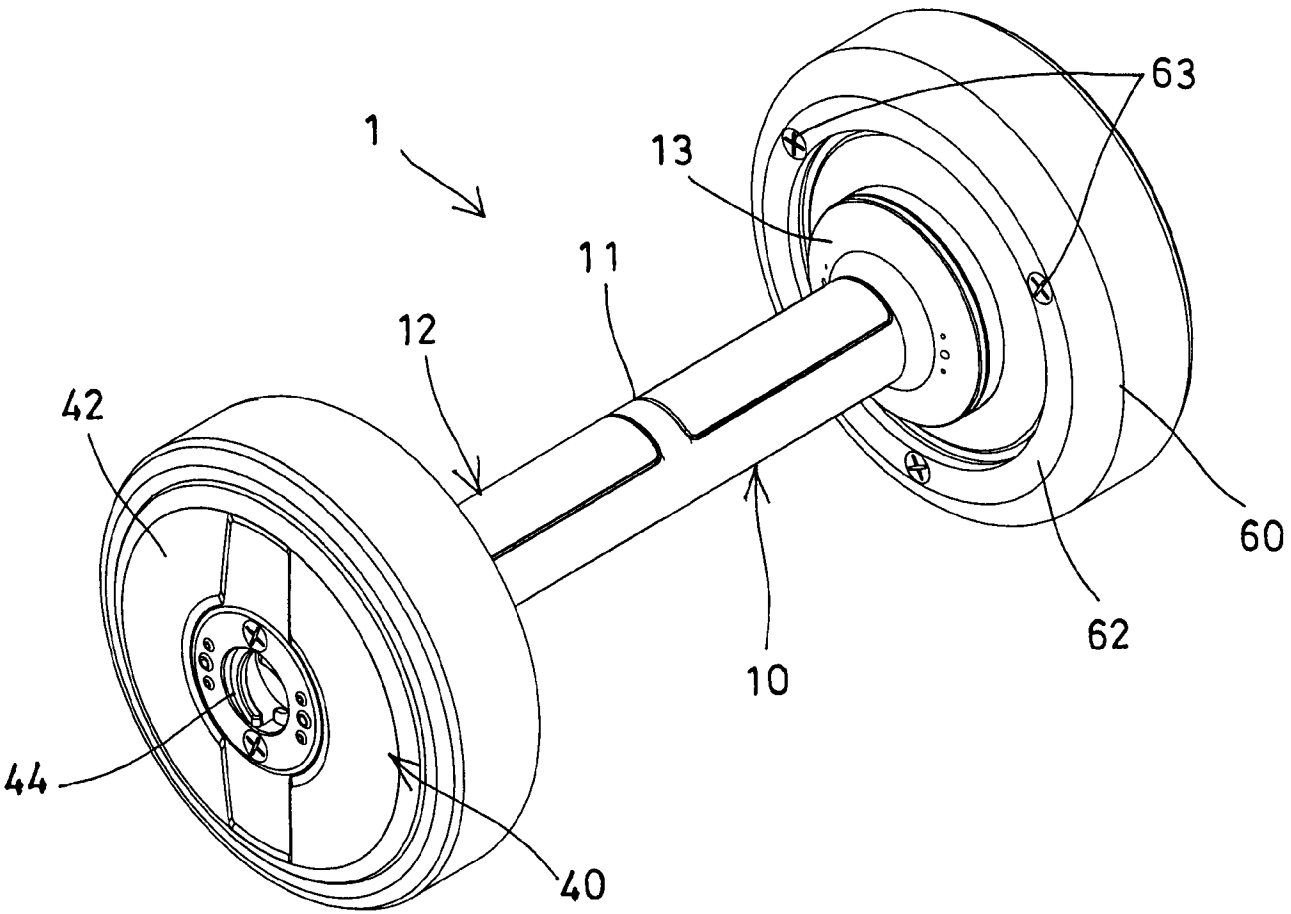
FIG. 2 is a perspective view of the barbell or dumbbell.

Referring to the drawings, and initially to FIGS. 1-5, a barbell or dumbbell or exercise device 1 in accordance with the present invention comprises a longitudinal shaft or handle 10 including a hand grip 11 formed or provided on the center portion thereof for being grasped or held by the users and for carrying or lifting or moving the handle 10 and for allowing the dumbbell 1 to be easily operated by the users, and including two end portions 12 each having a base plate or casing 13 formed or provided thereon.

The handle 10 further includes a hollow bore 14 formed therein, and includes one or more (such as two) peripheral swellings or supports 15 formed or provided therein or extended in the bore 14 of the handle 10 and each having an orifice 16 formed therein, and includes an outer peripheral shoulder 17 formed in each of the casings 13. The size or length or dimension of the handle 10 may be enlarged to form and to act as a barbell.

A longitudinal rod or pole 20 is disposed or engaged into the bore 14 of the handle 10 and engaged with or into or through the orifices 16 of the supports 15 of the handle 10 (FIG. 5), and includes two end portions 21 extended out of the handle 10, and the pole 20 is solidly attached or mounted or secured or coupled to the handle 10 with fasteners or latches (not shown), weldings, adhesive materials or the like. The pole 20 may be solidly attached to or formed integral with the handle 10 and may be formed as a part of the handle 10.

One or more (such as two) carriers 30 are solidly attached or mounted or secured or coupled to the end portions 21 of the pole 20 respectively with fasteners or latches (not shown), weldings, adhesive materials or the like, and each include an enlarged frame 31 formed or provided on the outer or free end portion thereof, and each may include a recess 32 formed in the frame 31 (FIG. 5) and facing outwardly or facing away from the handle 10 and the pole 20, in which the frame 31 preferably includes an outer diameter similar or identical or close to that of the casings 13 of the handle 10.

A weight plate or weight member 40 includes a compartment 41 formed therein for receiving or engaging with the respective end portion 21 of the pole 20 and the respective carrier 30, and includes an end plate or end wall 42 having a protrusion or anchor 43 extended therefrom and extended into the compartment 41 thereof for engaging with the recess 32 of the frame 31 of the respective carrier 30, and the anchor 43 of the weight member 40 may be solidly attached or mounted or secured or coupled to the respective carrier 30 with fasteners or latches or threading engagements (not shown), weldings, adhesive materials or the like.

It is preferable that the weight plates or weight members 40 each include a hand grip or knob 44 formed or provided in the end wall 42 for carrying or operating or moving or rotating the weight member 40 relative to the carrier 30 and the pole 20, and each include a ball guiding passage or raceway 45 formed in the outer peripheral portion thereof for receiving or engaging with a shaking or swiveling or vibrating or revolving or rolling device 50, such as a ball 50. The carrier 30 may be solidly attached to or formed integral with the weight member 40 and may be formed as a part of the weight member 40.

A ferrule or receptacle or housing 60 is attached or mounted or engaged onto each of the weight members 40, and includes a chamber 61 formed therein for receiving or engaging with the weight member 40, and includes a peripheral flange 62 extended radially and inwardly into the chamber 61 thereof and engaged with the weight member 40 and attached or mounted or secured to the weight member 40 with latches or fasteners 63 or weldings, or adhesive materials or the like for stably anchoring or securing or retaining the rolling device or ball 50 on or in the weight member 40.

Figure 4:
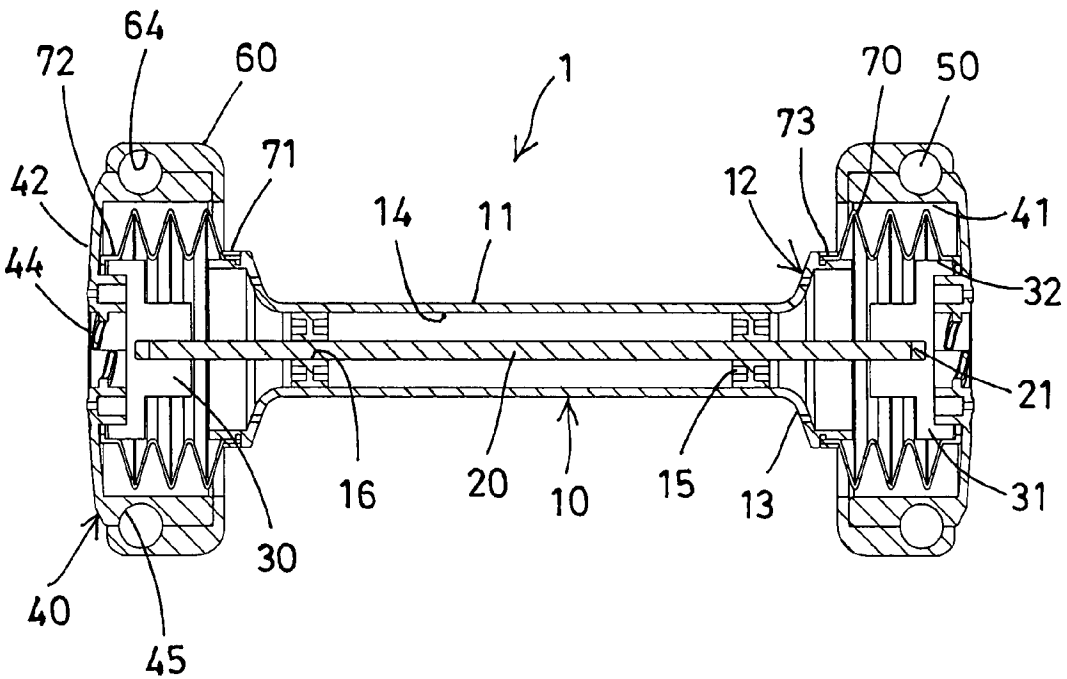
FIG. 4 is a cross sectional view of the dumbbell, taken along lines 4-4 of FIG. 3.
Figure 3:
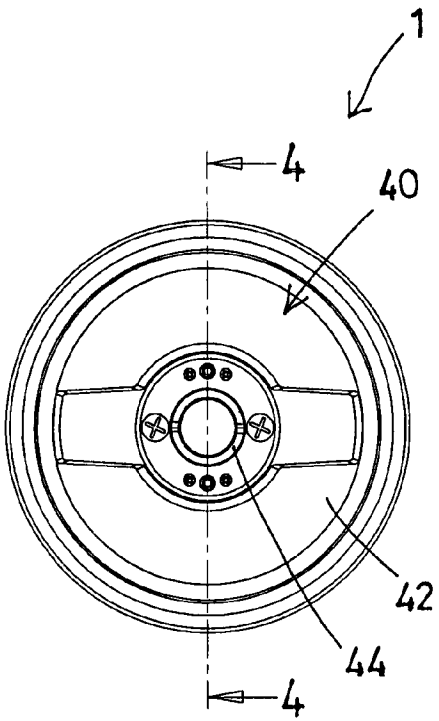
FIG. 3 is an end plan schematic view of the dumbbell.
Figure 5:
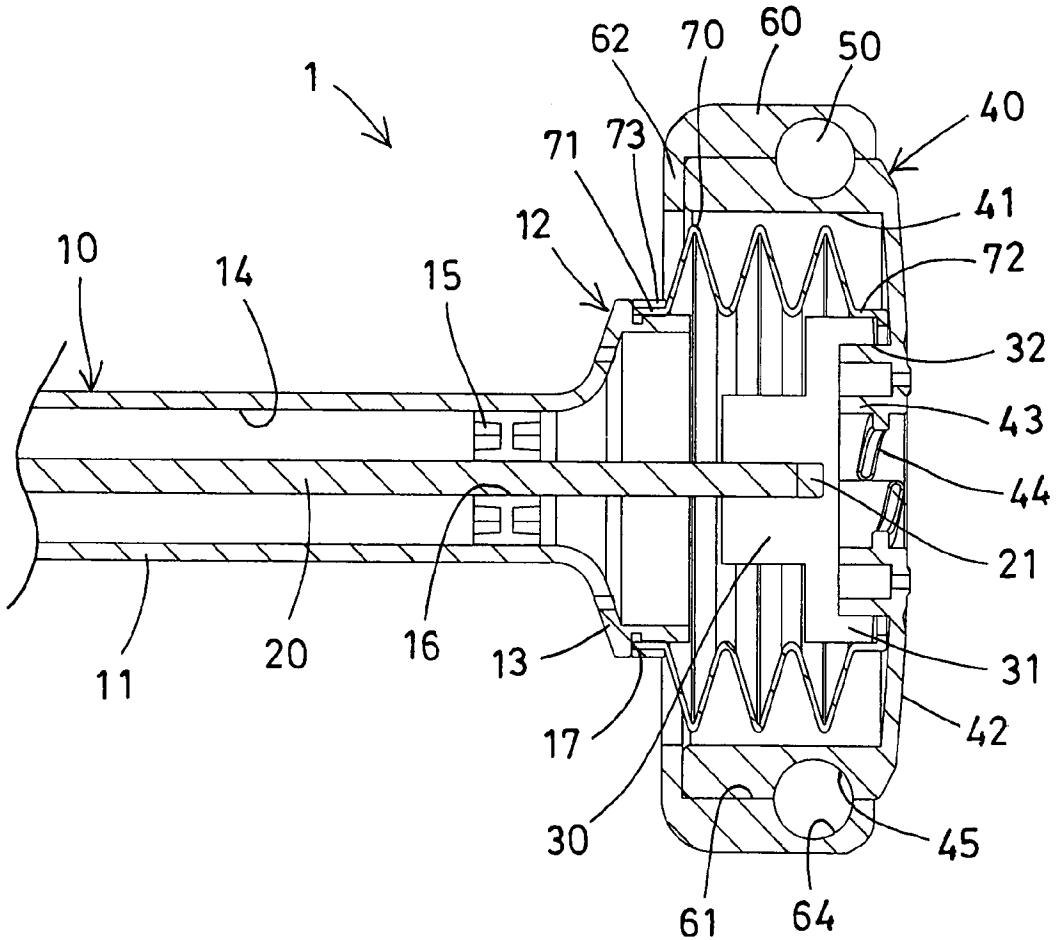
FIG. 5 is an enlarged partial cross sectional view of the dumbbell.

As shown in FIGS. 1, 4-5, the housing 60 may further include a ball guiding passage or raceway 64 (FIG. 5) formed in the inner peripheral portion thereof and aligned with the ball guiding passage or raceway 45 of the weight member 40 for receiving or engaging with the rolling device or ball 50 and for further stably anchoring or securing or retaining the rolling device or ball 50 on or in the weight member 40 and for preventing the rolling device or ball 50 from being disengaged from the weight member 40 and/or the housing 60.

The rolling device or ball 50 that is slidably received or engaged in the ball guiding passages or raceways 45, 64 of the weight member 40 and the housing 60, in operation, may be caused to move along the ball guiding passages or raceways 45, 64 of the weight member 40 and the housing 60 in order to generate a vibration to the handle 10 and/or the dumbbell 1 and for vibrating the hands of the user and for further exercising the upper muscle groups of the user.

Figure 6:
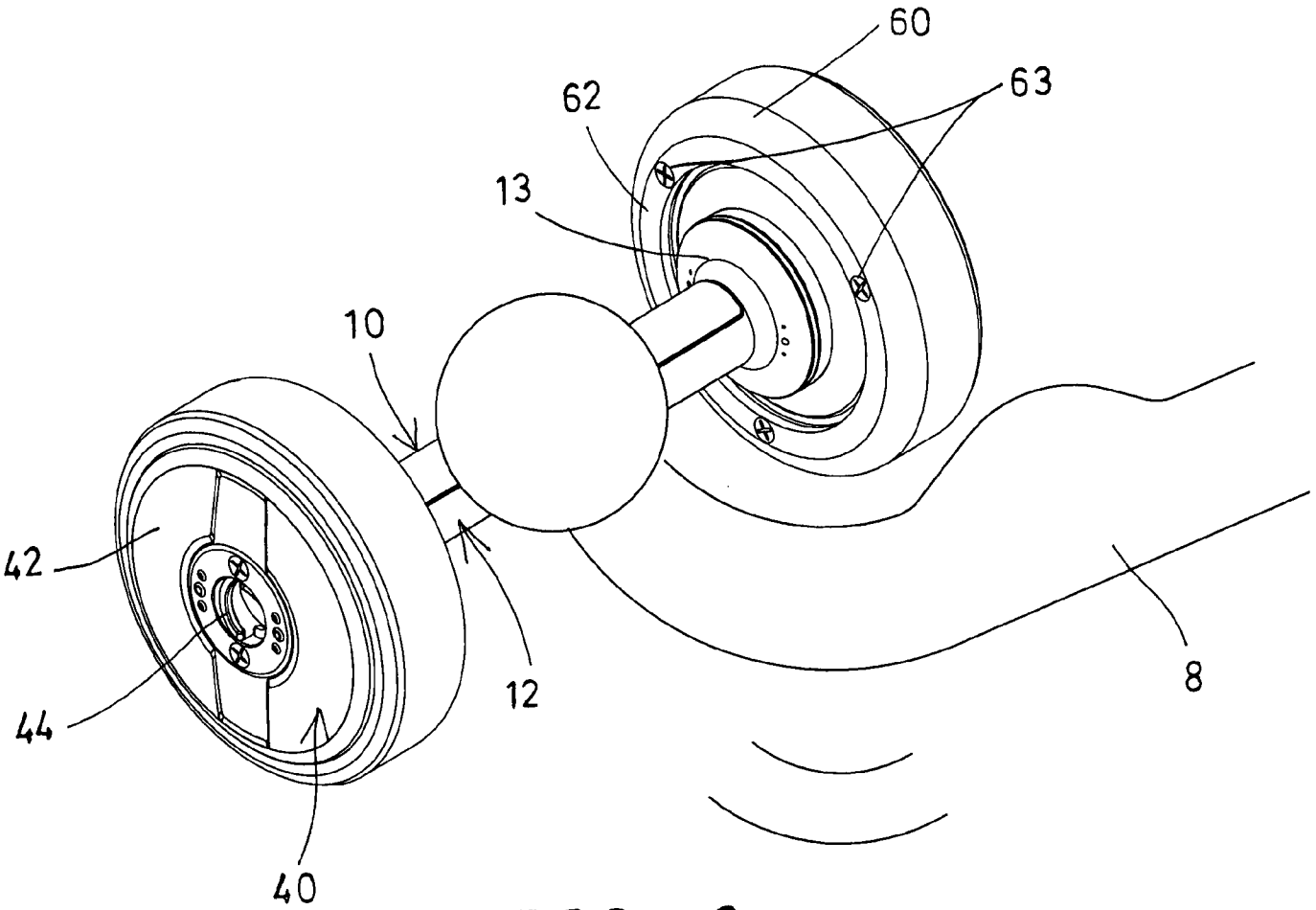
FIGS. 6, 7, 8 are perspective views similar to FIG. 2, illustrating the operation of the dumbbell.
Figure 7:
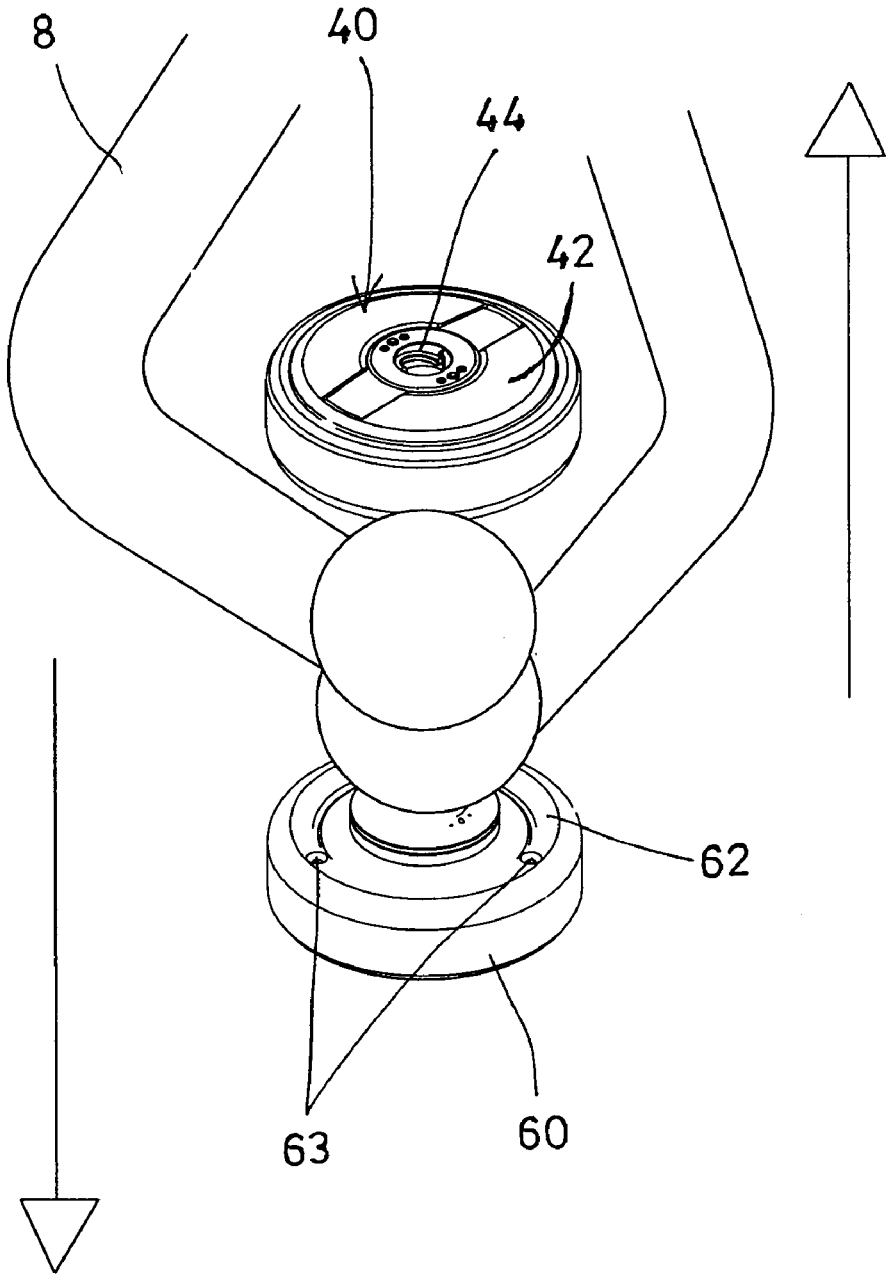
Figure 8:
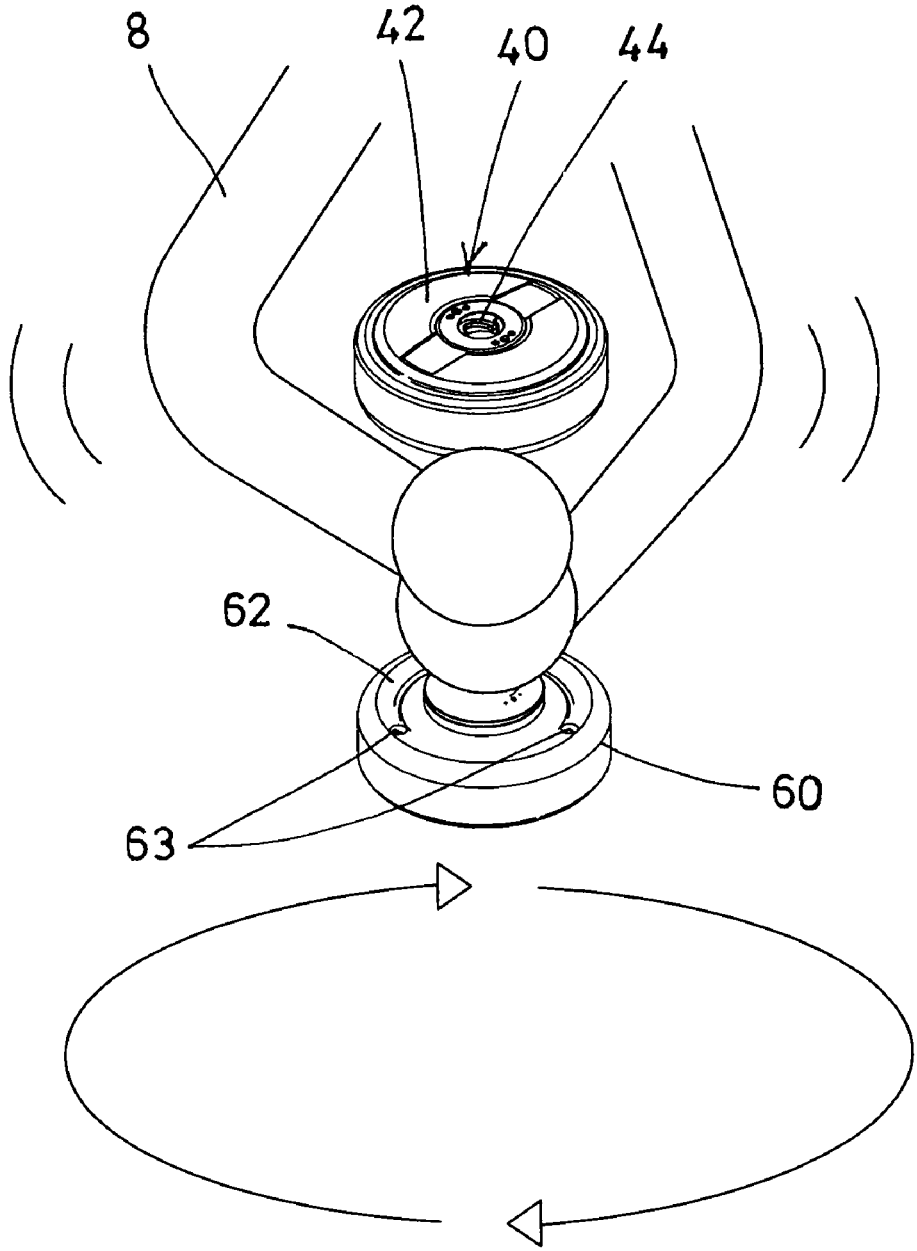

In operation, as shown in FIGS. 6-8, the user 8 may hold the handle 10 to conduct or operate various kinds of exercises, for example, as shown in FIG. 6, the user 8 may hold the handle 10 to conduct the typical dumbbell exercises in order to exercise the upper muscle groups of the user 8. As shown in FIG. 7, the user 8 may grasp and hold the handle 10 to shake the dumbbell 1 or to move the dumbbell 1 up and down in order to exercise the upper muscle groups of the user 8. As shown in FIG. 8, the user 8 may grasp and hold the handle 10 to rotate the dumbbell 1 and to move the rolling device or ball 50 along the ball guiding passages or raceways 45, 64 of the weight member 40 and the housing 60 in order to generate a vibration to the handle 10 and/or the dumbbell 1 and for vibrating the hands of the user 8 and for further exercising the upper muscle groups of the user 8.

As shown in FIGS. 1 and 4-5, a bellows-type cover or shield 70 may further be provided and attached or disposed or engaged into the compartment 41 of each of the weight members 40, and includes two end portions 71, 72 attached or mounted or secured to the casing 13 of the handle 10 and the frame 31 of the carrier 30 with retaining or clamping rings 73 for shielding or covering the spaces between the end portions 12 of the handle 10 and the carrier 30 and for preventing the dust or dirt from entering into the spaces between the end portions 12 of the handle 10 and the carrier 30.

Accordingly, the barbell or dumbbell or exercise device in accordance with the present invention includes a swiveling or shaking or vibrating or revolving or rolling device for generating a vibration to the weight member or to the weight carrier or the handle and for vibrating the hands of the user and for exercising the upper muscle groups of the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercise device comprising:

a handle including two end portions, a weight member for attaching to either of said end portions of said handle and including a ball guiding raceway formed therein, and a rolling device slidably received and disposed in said ball guiding raceway of said weight member and movable along said ball guiding raceway of said weight member for generating a vibration to said weight member and said handle, and said weight member including a housing attached onto said weight member and engaged with said rolling device for retaining said rolling device in said weight member, said housing including a chamber formed therein for receiving said weight member, and including a peripheral flange extended radially and inwardly into said chamber thereof and engaged with said weight member and secured to said weight member.

2. The exercise device as claimed in claim 1, wherein said handle include a bore formed therein and includes a pole engaged into said bore of said handle, and said pole includes two end portions extended out of said handle for supporting said weight member.

3. The exercise device as claimed in claim 2, wherein said weight member includes a carrier for attaching to either of said end portions of said pole, and includes a compartment formed therein for receiving said end portion of said pole and said carrier.

4. An exercise device comprising:

a handle including two end portions, a weight member for attaching to either of said end portions of said handle and including a ball guiding raceway formed therein, a rolling device slidably received and disposed in said ball guiding raceway of said weight member and movable along said ball guiding raceway of said weight member for generating a vibration to said weight member and said handle, and said weight member including a housing attached onto said weight member and engaged with said rolling device for retaining said rolling device in said weight member, said housing including a ball guiding raceway formed therein and aligned with said ball guiding raceway of said weight member for engaging with said rolling device.

5. An exercise device comprising:

a handle including two end portions, and including a bore formed therein, and including a pole engaged into said bore of said handle, and said pole including two end portions extended out of said handle, a weight member for attaching to either of said end portions of said handle and including a ball guiding raceway formed therein, and said weight member including a carrier for attaching to either of said end portions of said pole, and said weight member including a compartment formed therein for receiving said end portion of said pole and said carrier, and a rolling device slidably received and disposed in said ball guiding raceway of said weight member and movable along said ball guiding raceway of said weight member for generating a vibration to said weight member and said handle, and said carrier including a frame having a recess formed in said frame, and said weight member including an end wall having an anchor extended therefrom and engaged with said recess of said frame of said carrier and attached to said frame of said carrier.

6. An exercise device comprising:

a handle including two end portions, and including a bore formed therein, and including a pole engaged into said bore of said handle, and said pole including two end portions extended out of said handle, a weight member for attaching to either of said end portions of said handle and including a ball guiding raceway formed therein, and said weight member including a carrier for attaching to either of said end portions of said pole, and said weight member including a compartment formed therein for receiving said end portion of said pole and said carrier, a rolling device slidably received and disposed in said ball guiding raceway of said weight member and movable along said ball guiding raceway of said weight member for generating a vibration to said weight member and said handle, and a shield attached to said end portions of said handle and the carrier.

7. The exercise device as claimed in claim 6, wherein said handle includes a casing formed and provided on each of said end portions of said handle, and said carrier includes a frame, said shield is attached between said casing of said handle and said frame of said carrier.

* * * * *